US005935402A

United States Patent [19]

Fanti

[11] Patent Number: 5,935,402

[45] Date of Patent: Aug. 10, 1999

[54] PROCESS FOR STABILIZING ORGANIC ADDITIVES IN ELECTROPLATING OF COPPER

[75] Inventor: Lisa A. Fanti, Hopewell Junction, N.Y.

[73] Assignee: International Business Machines Corporation, Armonk, N.Y.

[21] Appl. No.: 09/169,294

[22] Filed: Oct. 9, 1998

Related U.S. Application Data

[62] Division of application No. 08/908,505, Aug. 7, 1997.

[51] Int. Cl.[6] ..... C25D 3/38

[52] U.S. Cl. ..... 205/101; 205/292; 205/296; 205/297; 205/298

[58] Field of Search ..... 205/101, 239–242, 205/291–298

[56] References Cited

U.S. PATENT DOCUMENTS

| | | | |
|---|---|---|---|
| 2,689,216 | 9/1954 | Nevers et al. | 205/292 |
| 2,766,202 | 10/1956 | Estes | 204/242 |
| 3,553,096 | 1/1971 | Coir | 204/297 W |
| 3,743,583 | 7/1973 | Castonguay | 205/125 |
| 4,328,076 | 5/1982 | Fisher et al. | 205/80 |
| 4,469,564 | 9/1984 | Okinaka et al. | 204/125 |
| 4,605,483 | 8/1986 | Michaelson | 204/280 |
| 4,666,580 | 5/1987 | Beaver et al. | 204/254 |
| 4,698,143 | 10/1987 | Morris et al. | 204/253 |
| 4,975,159 | 12/1990 | Dahms | 205/125 |
| 5,143,593 | 9/1992 | Ueno et al. | 205/291 |
| 5,516,412 | 5/1996 | Andricacos et al. | 204/224 R |

FOREIGN PATENT DOCUMENTS 58-177488 10/1983 Japan .

OTHER PUBLICATIONS

Lawrence J. Durney, *Electroplating Engineering Handbook*, 4th Edition, pp. 235–240 and pp. 660–662, 1984. month not available.

William H. Safranek, "Acid Copper Electroplating and Electroforming," *Modern Electroplating*, 3rd Edition, pp. 182–203, 1974. month not available.

*Primary Examiner*—Kathryn Gorgos
*Assistant Examiner*—William T. Leader
*Attorney, Agent, or Firm*—Ratner & Prestia; Ira D. Blecker

[57] ABSTRACT

A process and assembly for stabilizing organic additives in an electrolytic solution while electroplating copper. The process includes forming a protective film on a first surface of an anode and minimizing contact between the electrolytic solution and a second surface of the anode which is further from the cathode than the first surface. An anode housing is used to minimize contact between the electrolytic solution and the second surface of the anode. The housing includes two side walls and a bottom wall, each having a groove, and a sealing back plate. The anode is fitted in the grooves such that the first surface of the anode is in contact with the electrolytic solution and the second surface of the anode abuts against the sealing back plate. The anode housing may be used in an electroplating system including the anode housing, a plating tank containing the electrolytic solution, a cathode immersed in the electrolytic solution, and an anode, which preferably is in the shape of a slab.

8 Claims, 2 Drawing Sheets

PROCESS FOR STABILIZING ORGANIC ADDITIVES IN ELECTROPLATING OF COPPER

This application is a divisional application of U.S. patent application Ser. No. 08/908,505, filed on Aug. 7, 1997, still pending.

FIELD OF THE INVENTION

This invention relates to minimizing the degradation of organic additives used to improve copper brightness, smoothness, and feature filling in copper plating systems.

BACKGROUND OF THE INVENTION

A typical electroplating system consists of a cathode, an anode, and an electrolytic solution. The cathode is the work piece upon which metal is to be plated, and the anode functions as the counter-electrode in the electrochemical cell. The electrolytic solution contains dissolved metal ions along with other constituents which influence deposit quality. The cathode and anode are immersed in the electrolytic solution and connected by a power supply. A voltage difference is applied between the cathode and anode, and current flows freely from the anode to the cathode.

At the cathode surface, metal is deposited as metal ions are reduced to their base form via an electrochemical reaction: $M^{+v}+v\ e^- \rightarrow M^0$. To conserve charge, an electrochemical reaction also occurs at the anode surface and can be one of two types. If the anode is soluble at the potential being applied, it dissolves and releases metal ions into solution: $M^0 \rightarrow M^{+v}+v\ e^-$. If the anode is insoluble at the potential being applied, a gas evolution reaction, such as $2\ O^{-2} \rightarrow O_2+4\ e^-$, occurs at the anode. A variety of other side reactions are also possible at both the cathode and the anode.

In electrolytic copper plating, the actual properties of the deposited metal are a strong function of local agitation, current density, and the exact concentration of all bath components, including organic additives. It is well known that bright, smooth copper deposits cannot be obtained without the presence of organic additives. Such additives must be controlled during production in order to obtain consistent metallurgical properties, including grain structure, brightness, smoothness, leveling, and purity. The degree to which various additives must be controlled is a strong function of the application at hand. Perhaps the most demanding applications lie within the microelectronics industry, where very small metal features need to be synthesized, without irregularities or surface anomalies.

Several of the common additives, including a copper brightener and grain refiner sold under the trademark CuBath M-D by Enthone-OMI Corporation, are easily oxidized at the bare anode surface. This electrochemical degradation can cause a continuous depletion of the organic additives which can lead to poor metal quality if not properly controlled. On the other hand, increased stability of the organic additives leads to longer lifetimes of the electroplating baths which is economically very important. For example, frequent replacement of the bath interrupts the copper plating operation which reduces product yield and requires replacement of the chemicals in the new bath as well as disposal of the chemicals in the old bath. Accordingly, there is a need for a device, process, or additive which would stabilize organic additives within an electrolytic solution to preserve deposit quality and extend bath life.

Efforts along these lines have been made. For example, some attempts have been made to control additive degradation by separating the anode from the bulk solution by using a membrane. Membranes that restrict the passage of additives usually also restrict passage of copper ions, which can cause over-potential problems at the anode surface. This problem can only be combated with a complex exchange scheme within the anode chamber. Other efforts have focused upon implementing steady-state bath exchange schemes, in which old solution is discarded to remove harmful breakdown products, and new solution is added to replenish additives. Bath exchange schemes are viable, but are clearly more cumbersome and costly than preventing the problem at the outset.

The breakdown of organic additives in the presence of copper can be significantly retarded by forming a protective film on the anode surface. However, an additional problem is encountered when the particular cathode to be plated requires that a relatively low cathode current density be used. In these cases, forming such a protective film over the anode surface has been accomplished only with difficulty. More specifically, the areas of the anode remote from the cathode can only be completely filmed by increasing the current density, which might not be possible due to the product requirements of the cathode. When subsequently plating copper in a system having an anode which has only been partially covered with a protective film, the organic additives tend to be consumed at the unprotected anode surface.

SUMMARY OF THE INVENTION

In view of the need to extend the life of an electroplating bath while maintaining deposit quality, the present invention provides a process and system which minimizes the decomposition of organic additives at the anode surface. According to the process of the present invention, a protective film is formed on a first surface of an anode which also includes a second surface further from the cathode than the first surface. The process includes minimizing contact between the second surface and the electrolytic solution. In this way, the organic additives in an electrolytic solution are stabilized while copper is electroplated.

According to a preferred embodiment of the process of the present invention, the step of forming the protective film includes first dissolving chloride ions in the electrolytic solution then passing current to the anode and through the electrolytic solution to form the protective film on the first surface. According to this embodiment, the protective film typically is a cuprous chloride layer. Even more preferably, the protective film is protected from dissolution by not permitting an extended period (e.g., greater than two days) of no plating activity.

According to another embodiment of the present invention, an anode housing includes two side walls and a bottom wall, each of which has a groove. The housing includes a sealing back plate, which is coupled to the two side walls and the bottom wall, and an anode is fitted within the grooves. In this way, a first surface of the anode is in contact with the electrolytic solution, while a second surface of the anode abuts against the sealing back plate and is substantially sealed from the electrolytic solution.

According to yet another embodiment of the present invention, an electroplating system includes a plating tank containing an electrolytic solution having at least one organic additive. The system also includes a cathode and an anode. The cathode is immersed in the electrolytic solution and is the work piece to be plated with metal. The anode has a first surface and a second surface. The first surface is coated with a protective film and is closer to the cathode than the second surface. The system of this embodiment of the invention also includes a structure, such as the anode housing discussed above, which minimizes contact between the second surface and the electrolytic solution.

According to still another embodiment of the present invention, an electroplating system includes a plating tank having a first side and a second side opposite from the first side and containing an electrolytic solution having dissolved metal ions and at least one organic additive. The system also includes a cathode, an anode housing, and an anode. The cathode is a work piece to be plated with metal from the metal ions of the electrolytic solution and is immersed in the electrolytic solution. The cathode is disposed in the plating tank near the first side of the tank. The anode housing, which is disposed within the plating tank near the second side, has a sealing back plate, a first side wall defining a first groove near the back plate, a second side wall defining a second groove near the back plate, and a bottom wall defining a third groove aligned with the first and second grooves. The anode, which may be a solid slab of copper and phosphorous, engages the three grooves. A first surface of the anode is coated with a protective film and is closer to the cathode than a second surface of the anode. The second surface abuts against the back plate. The engagement of the anode in the three grooves and the abutment of the second surface against the back plate (and, to a lesser extent, the placement of the anode housing against the side wall of the plating tank) minimizes contact between the second surface and the electrolytic solution.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

The present invention is directed to a process and apparatus for stabilizing organic additives used in an electrolytic solution for electroplating copper. As used herein, the term "organic additives" shall mean any organic additive which is added to copper electroplating baths to improve various aspects of the plating process, including, but not limited to, the brightness of the copper plating, the physical properties of the plated copper (e.g., ductility), smoothness, grain structure, and thickness uniformity. Generally, organic additives regulate both the kinetics and mass transfer of the plating process, resulting in a more favorable deposit. Some exemplary organic additives are disclosed in U.S. Pat. No. 4,469,564 to Okinaka et al. The passage bridging column 4, line 23 through column 6, line 40 of the '564 patent is incorporated herein by reference.

Figure 1:
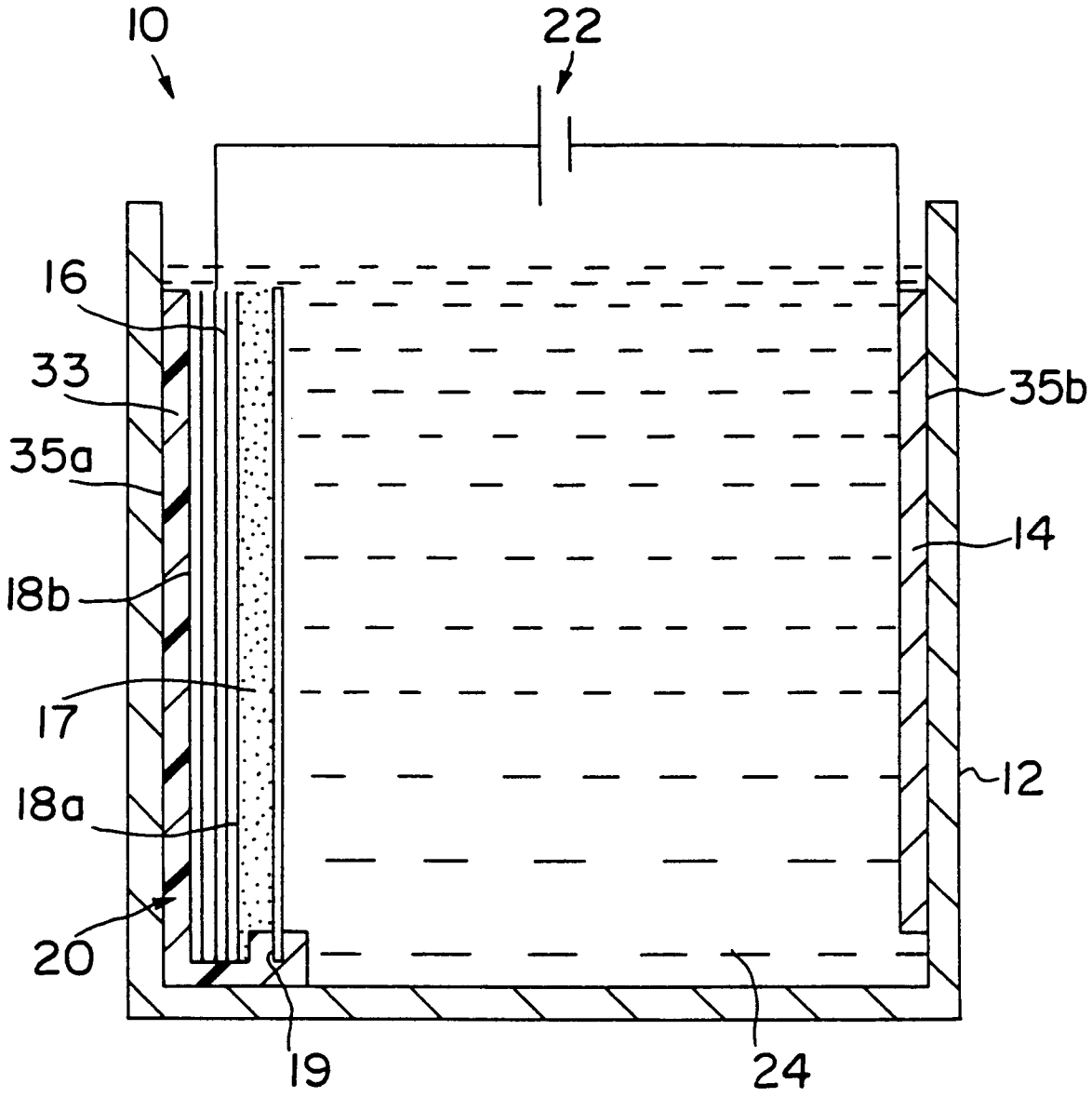
FIG. 1 is a side cross-sectional view of an electroplating system according to the present invention.
Figure 3:
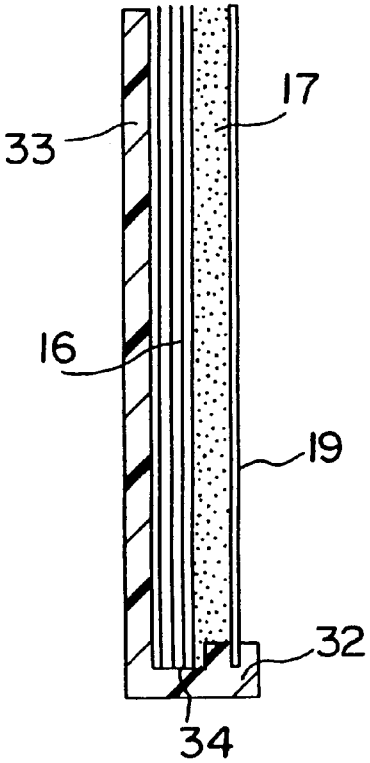
FIG. 3 is a side cross-sectional view of the anode housing shown in FIG. 2.
Figure 2:
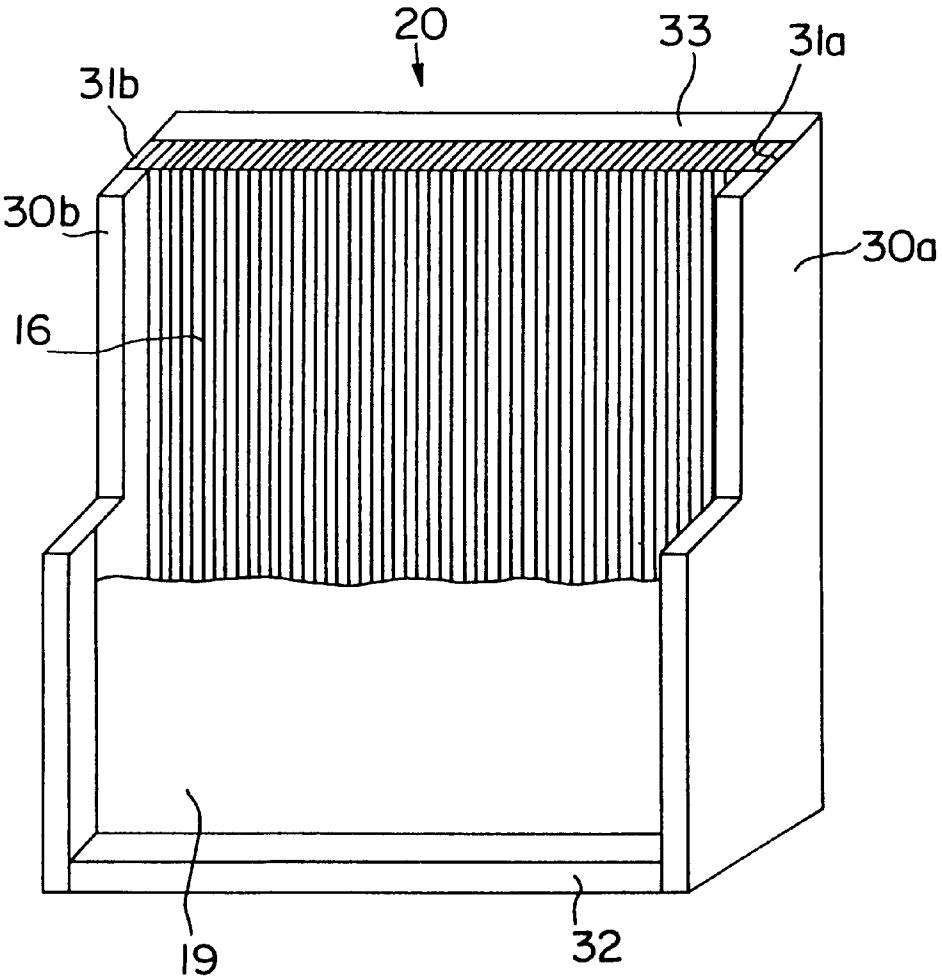
FIG. 2 is a front perspective view of an anode housing according to the present invention, with the side walls and anode bag partially cut away.

Referring now to the drawing, wherein like reference numerals refer to like elements throughout, FIG. 1 shows an electroplating system 10 which includes a plating tank 12, a cathode 14, an anode 16, and an anode housing 20 (shown also in FIGS. 2 and 3). An electroplating system such as this can be used in the manufacture of electroplated copper wiring for microelectronics applications and is driven by a voltage source 22 which applies a voltage drop between anode 16 and cathode 14. As discussed in the background, dissolved metal contained within an electrolytic solution 24 is plated onto cathode 14 by passing a current from voltage source 22, to anode 16, through electrolytic solution 24, then to cathode 14, which is immersed in electrolytic solution 24. Thus, cathode 14 is the work-piece such as a wafer or substrate which is plated during the electroplating process.

In the embodiment shown in FIG. 1, plating tank 12, which contains electrolytic solution 24 having at least one organic additive, is shown in the shape of a box with an open top. The present invention is compatible with any known shape of a plating tank. For example, it is known to use a cylindrical plating tank in cup plating in which anode 16 is placed on the bottom of the tank. The plating tank may be any material conventionally used for such tanks, such as glass, coated metal, or plastic.

The material used for anode 16 may be copper and phosphorous, with the phosphorous content approximately 0.05 atomic percent, although other materials are compatible. The phosphorous helps promote isotropic dissolution of the copper, preventing small copper fines from being released into solution. Copper and phosphorous anodes are available in a variety of configurations, including balls, nuggets, and slabs. Although only slabs are shown in the drawing, other configurations of anodes may be used with the process of the present invention.

Anode housing 20, shown independently in FIGS. 2 and 3, is generally in the shape of a rectangular prism with an open top and front. Anode housing 20 may be made of any material conventionally used for a plating tank, but preferably is plastic. Anode housing 20 includes a first side wall 30*a*, a second side wall 30*b*, a bottom wall 32, and a sealing back plate 33. First side wall 30*a* defines a first groove 31*a*, and second side wall 30*b* defines a second groove 31*b*. Similarly, bottom wall 32 defines a third groove 34. Bottom wall 32 is coupled to first side wall 30*a* and second side wall 30*b* at the bottoms of the two side walls, and all three grooves are aligned (i.e., coplanar). Sealing back plate 33 is coupled to bottom wall 32, first side wall 30*a*, and second side wall 30*b* at the rear of the three walls and near the grooves.

As shown, anode 16 is fitted within first groove 31*a*, second groove 31*b*, and third groove 34 such that a first surface 18*a* of anode 16 faces the front of anode housing 20 and a second surface 18*b* of anode 16 abuts against sealing back plate 33. In the embodiment shown, anode housing 20 including anode 16 is situated near a first side 35*a* of plating tank 12 which is opposite a second side 35*b* of plating tank 12. Cathode 14 is disposed at second side 35*b*. Thus, a uniform separation between cathode 14 and anode 16 is provided. In the embodiment shown, anode housing 20 is disposed in plating tank 12 such that sealing back plate 33 abuts against first side 35*a* of plating tank 12. Anode housing 20 may be situated at any point in plating tank 12, depending on the needs of the particular plating process. Anode housing 20 can be maintained in place in plating tank 12 by a bolt, a vice grip, a friction fit, or by forming tongue-and-groove assembly between anode housing 20 and plating tank 12.

With this configuration, contact between electrolytic solution 24 and second surface 18*b* of anode 16 is minimized. Thus, there is no bulk flow of electrolytic solution 24 by convection to second surface 18*b*, but only minimal transport by diffusion. Electrolytic solution 24 is substantially prevented, therefore, from flowing to second surface 18*b*. Preferably, the gap between anode 16 and anode housing 20 is watertight so that the flow is entirely eliminated, at least initially. Of course, as anode 16 becomes significantly consumed and the gap widens, the anode will be replaced as needed. Thus, when the gap widens enough such that anode 16 no longer fits snugly into anode housing 20 such that second surface 18*b* is no longer well-sealed, the anode must be changed.

As mentioned above, the present invention is compatible with any known shape of plating tank. In the case of cup plating, the tank is cylindrical and the anode housing would be configured as a cylinder with an open top and a groove formed at its inner periphery to retain and seal the circular anode. Also, the anode housing shown in the figures could be constructed as an integral unit, in which case the three grooves would be viewed as a single groove.

As shown in the figures, a protective film 17 is formed on first surface 18*a* of anode 16 closer to cathode 14. Protective film 17 on anode 16 retards consumption of organic additives at the anode surface, because oxidation occurs more readily at a bare anode surface than at an anode surface on which a protective film has been formed. Protective film 17 is formed by dissolving chloride ions (although any halide should be compatible) in electrolytic solution 24, typically at a low concentration of chloride ions of about 50–100 ppm. Then, current is passed to anode 16 in the presence of the dissolved chloride ions. The result is a black layer composed primarily of cuprous chloride on first surface 18*a* that inhibits catalytic decomposition. Although the protective film 17 includes constituents other than cuprous chloride, protective film 17 will be referred to as the "cuprous chloride layer."

Once protective film 17 is formed, it must be maintained by continuous plating and must be protected from extreme mechanical agitation. Continuous plating occurs by passing a current to anode 16 and through electrolytic solution 24 to cause plating of metal on cathode 14. The term "continuous plating" includes brief stoppages in plating, for example to replace a plated cathode with a new cathode, as long as the stoppage in plating is not long enough to significantly degrade protective film 17. In the event that continuous plating is not required by product demand, then intermittent plating of a product or plating of a "dummy" cathode (i.e., a non-product cathode which is used merely to pass current) may be employed.

In order to retain any fines from anode 16, an anode bag 19 is attached to side walls 30*a* and 30*b* and bottom wall 32 of anode housing 20. As is well known, the anode bagging material may be polypropylene and is in the form of a layered, woven cloth.

The present invention is compatible with a variety of commercially available electrolytic plating solutions, including solutions for electrolytically depositing copper wiring for thin-film electronic packaging applications. A preferred method for manufacturing copper wiring for high-end packaging applications is using the Sel-Rex CuBath M-D system. Also, several different product types can be plated using the present invention, including both "through-the-mask" and "blanket damascene" structures. The present invention can be used to fill features with dimensions in the 8–20 $\mu$m range and can be applied to wafer plating applications, where dimensions are in the sub-micron range. The invention produces uniform deposits which are bright and free of surface roughness. The invention is not in any way restricted to the Sel-Rex CuBath M-D system, but is widely applicable to any copper plating system in which the degradation of organic additives is accelerated in the presence of bare copper anodes.

A consideration in implementing the present invention is the use of analytical techniques to accurately monitor the concentrations of the organic additives in the bath. In the case of CuBath M-D, a high performance liquid chromatography (HPLC) procedure was implemented. Once this technique was reliably in place, extensive studies were conducted to determine the appropriate process windows for all bath components, including CuBath M-D. Dimensional, cross-sectional, and resistivity analyses showed that a CuBath M-D concentration of greater than 2.0 ml/l was required to produce acceptable deposits. Concentrations lower than 2.0 ml/l repeatedly exhibited surface roughness, nodules, and sub-standard leveling.

It appears that the present invention virtually eliminates breakdown of organic additives at the anode surface for fine-feature plating applications for two reasons. First, the entire front side of the anode lies within the line-of-site of the cathode, and can be completely filmed (with the protective film) in a short amount of time. Although the backside of the anode does not film, it is only accessible to plating solution by diffusion. Therefore, the amount of catalytic decomposition of additives that can occur there is negligible. Second, the planar anode configuration permits anode current densities many times larger than those than can be practiced using balls due to the smaller surface area of a planar anode as opposed to balls. Thus, even at relatively low current densities required by some cathode products, a relatively higher anode current density can be achieved by using a planar anode configuration. In this embodiment, the anode current density can be adjusted to a variety of values by merely corrugating the anode surface (as shown in FIG. 3). In summary, the entire anode filming process can be optimized.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A process for stabilizing organic additives in an electrolytic solution while electroplating copper, said process comprising the steps of:

forming a protective film on a first surface of an anode, said first surface closer to a cathode than a second surface of said anode; and minimizing contact between said second surface and said electrolytic solution.

2. The process of claim 1, wherein the electrolytic solution is contained in a plating tank and the step of minimizing contact between said second surface and said electrolytic solution comprises disposing said anode in an anode housing such that said first surface is in contact with said electrolytic solution and said electrolytic solution is substantially prevented from flowing to said second surface.

3. The process of claim 2, wherein the step of disposing said anode within said anode housing comprises forming at least one groove in said anode housing and fitting said anode in said groove.

4. The process of claim 3, wherein said anode housing includes a sealing back plate which abuts against said second surface.

5. The process of claim 1, wherein said anode is a copper and phosphorous anode, and the step of forming the protective film comprises:

dissolving chloride ions in said electrolytic solution; and passing current to said anode and through said electrolytic solution to form said protective film consisting of a cuprous chloride layer on said first surface.

6. The process of claim 1, wherein said electrolytic solution includes dissolved metal ions and said method further comprises, after the step of forming the protective film, passing a current to said anode and through said electrolytic solution to cause plating of metal on said cathode.

7. The process of claim 1 further comprising protecting said protective film from mechanical agitation.

8. The process of claim 1 further comprising providing an anode bag across the front of said first surface of said anode on which said protective film is formed.

* * * * *